US010329654B2

(12) United States Patent
Monzen et al.

(10) Patent No.: US 10,329,654 B2
(45) Date of Patent: Jun. 25, 2019

(54) METHOD FOR MANUFACTURING COPPER ALLOY AND COPPER ALLOY

(71) Applicants: NGK Insulators, Ltd., Nagoya (JP); National University Corporation Kanazawa University, Kanazawa (JP)

(72) Inventors: Ryoichi Monzen, Kanazawa (JP); Naokuni Muramatsu, Nagoya (JP)

(73) Assignees: NGK Insulators, Ltd., Nagoya (JP); National University Corporation Kanazawa University, Kanazawa-Shi (JP)

( * ) Notice: Subject to any disclaimer, the term of this patent is extended or adjusted under 35 U.S.C. 154(b) by 248 days.

(21) Appl. No.: 14/955,318

(22) Filed: Dec. 1, 2015

(65) Prior Publication Data

US 2016/0083826 A1 Mar. 24, 2016

Related U.S. Application Data

(63) Continuation of application No. PCT/JP2014/064837, filed on Jun. 4, 2014.

(30) Foreign Application Priority Data

Jun. 4, 2013 (JP) ..... 2013-117634

(51) Int. Cl.
*C22F 1/08* (2006.01)
*C22C 9/06* (2006.01)
(Continued)

(52) U.S. Cl.
CPC ..... *C22F 1/08* (2013.01); *C21D 1/18* (2013.01); *C22C 9/02* (2013.01); *C22C 9/06* (2013.01)

(58) Field of Classification Search
CPC .... C21D 1/18; C22C 9/02; C22C 9/06; C22F 1/08
See application file for complete search history.

(56) References Cited

U.S. PATENT DOCUMENTS 3,198,499 A 8/1965 Stanley
3,937,638 A 2/1976 Plewes
(Continued)

FOREIGN PATENT DOCUMENTS

CN 102560191 A 7/2012
CN 102719699 A 10/2012
(Continued)

OTHER PUBLICATIONS

Extended European Search Report (Application No. 14807420.6) dated Nov. 30, 2016.
(Continued)

*Primary Examiner* — Veronica F Faison
(74) *Attorney, Agent, or Firm* — Burr & Brown, PLLC

(57) ABSTRACT

A method for manufacturing a copper alloy of the present invention is a method for manufacturing a Cu—Ni—Sn-based copper alloy and includes: a first aging treatment step of performing an aging treatment in a temperature range of 300° C. to 500° C. using a solution treated material; an inter-aging processing step of performing cold working after the first aging treatment step; and a second aging treatment step of performing an aging treatment in a temperature range of 300° C. to 500° C. after the inter-aging processing step. In the first aging treatment step, a peak aging treatment is preferably performed. In addition, in the second aging treatment step, the aging treatment is preferably performed for a short period as compared to that of the aging treatment in the first aging treatment step. In the inter-aging processing
(Continued)

step, cold working is preferably performed at a processing rate of more than 60% to 99%.

10 Claims, 9 Drawing Sheets

(51) Int. Cl.
*C21D 1/18* (2006.01)
*C22C 9/02* (2006.01)

(56) References Cited

U.S. PATENT DOCUMENTS

| | | | | |
|---|---|---|---|---|
| 4,612,167 | A * | 9/1986 | Watanabe | C22C 9/06 257/E23.053 |
| 5,019,185 | A | 5/1991 | Nakajima et al. | |
| 5,028,282 | A | 7/1991 | Kubozono et al. | |
| 5,089,057 | A * | 2/1992 | Plewes | C22F 1/08 148/412 |
| 2002/0007879 | A1 * | 1/2002 | Nielsen, Jr. | C22C 9/02 148/433 |
| 2005/0028907 | A1 | 2/2005 | Hasegawa et al. | |
| 2009/0183803 | A1 * | 7/2009 | Mutschler | C22F 1/08 148/554 |
| 2011/0240180 | A1 * | 10/2011 | Gao | C22C 9/06 148/554 |
| 2012/0148439 | A1 * | 6/2012 | Shishido | C22C 1/02 420/473 |
| 2014/0190596 | A1 * | 7/2014 | Inoue | C22F 1/08 148/554 |
| 2014/0261925 | A1 | 9/2014 | Wetzel et al. | |

FOREIGN PATENT DOCUMENTS

| | | | |
|---|---|---|---|
| JP | 59-096254 | A1 | 6/1984 |
| JP | 63-266055 | A1 | 11/1988 |
| JP | 02-225651 | A1 | 9/1990 |
| JP | 06-037680 | B2 | 5/1994 |
| JP | 07-090520 | A1 | 4/1995 |
| JP | 2625965 | B2 | 7/1997 |
| JP | 2009-242884 | A1 | 10/2009 |
| JP | 2009-242890 | A1 | 10/2009 |
| JP | 2009-242895 | A1 | 10/2009 |
| JP | 2012-046801 | A1 | 3/2012 |

OTHER PUBLICATIONS

International Search Report and Written Opinion (Application No. PCT/JP2014/064837) dated Jul. 22, 2014.

Materion Brush Inc., et al., "BrushForm® 158 Cold Rolled Tempers," Materion Datasheet [online], <URL:http://materion.com/~/media/Files/PDFs/Alloy/DataSheets/Copper%20Nickel%20Tin%20Strip/Brushforms-DataSheets-Brushform158ColledRolled.pdf>; dated 2011 (1 page).

Jiang, Bohong, et al., "Study of Cu—15Ni—8Sn and Cu—15Ni—8Sn—02Nb Spinodal Decomposition Type Elastic Alloys," (With English Translation), *China Academic Journal Electronic Publishing House*, dated 1989 (20 pages).

Louzon, T.J., et al., "Producing High-Strength Ductile Cu—10Ni—8Sn Alloy Wire," *Wire Journal International*, dated Nov. 1983 (8 pages).

English translation of International Preliminary Report on Patentability (Application No. PCT/JP2014/064837) dated Dec. 17, 2015.

Chinese Office Action (Application No. 201480031814.X) dated Nov. 21, 2016 (with English translation).

Nachi Institute of Heat Treatment, Heat Treatment Instructions, Apr. 30, 1988, pp. 81-84.

Chinese Office Action (Application No. 201480031814X) dated Jul. 26, 2017 (with English translation).

* cited by examiner

※ α-phase and L1$_2$ Precipitate Matched.

※ α-phase and D0$_{22}$ Precipitate Matched with the Direction Relationship below: $(111)_{\alpha}//(112)_{D022}$, $[112]_{\alpha}//[111]_{D022}$

METHOD FOR MANUFACTURING COPPER ALLOY AND COPPER ALLOY

BACKGROUND OF THE INVENTION

1. Field of the Invention

The present invention relates to a method for manufacturing a copper alloy and a copper alloy.

2. Description of the Related Art

Heretofore, since a Cu—Ni—Sn-based copper alloy is formed of relatively inexpensive metal elements and has a high mechanical strength, this copper alloy has been used as a rolled material of a practical alloy. In addition, a Cu—Ni—Sn-based copper alloy has been known as a spinodal decomposition type age-hardening alloy and has also been known as a copper alloy having an excellent heat resistance, that is, excellent stress relaxation characteristics at a high temperature, such as 200° C.

As a method for manufacturing a Cu—Ni—Sn-based copper alloy, for example, a method has been proposed in which, for example, a heat treatment in a temperature range of 600° C. to 770° C., an inter-aging processing at a processing rate of 0% to 60%, and a heat treatment in a temperature range of 350° C. to 500° C. for 3 to 300 minutes are sequentially performed (see Patent Literatures 1 and 2). It is disclosed that, in this method, unlike a heat treatment method performed from a single phase region at approximately 800° C. or more, a heat treatment is preformed from a temperature region of 600° C. to 770° C. at which two phases are in an equilibrium state, the structure is formed so that the two phases are uniformly dispersed in the matrix under room temperature conditions, and as a result, fatigue characteristics are improved. In addition, by an aging treatment performed at 350° C. to 500° C., the fatigue characteristics are further improved. Furthermore, a method performing a solution treatment at 800° C. or more prior to the heat treatment performed in a temperature range of 600° C. to 770° C. disclosed in Patent Literatures 1 and 2 has also been proposed (see Patent Literatures 3 and 4). It is disclosed that, in this method, since a processed structure present in an alloy can be completely eliminated by a heat treatment performed at 800° C. or more in a single phase region, besides the improvement in fatigue characteristics, the moldability and the stress relaxation characteristics can also be improved. In addition, another method has been proposed in which, after a solution treatment and a cold rolling treatment are performed on a Cu—Ni—Sn-based copper alloy in this order, a heat treatment is performed at a temperature of 250° C. to 500° C. for 1 hour or more, and continuous annealing is then performed at a temperature of 300° C. to 600° C. for 1 to 20 minutes (see Patent Literature 5). It is disclosed that, by this method, a flat mill-hardened material can be efficiently obtained.

CITATION LIST

Patent Literature

PTL 1: JP 63-266055 A
PTL 2: JP 6-37680 A
PTL 3: JP 2625965 B
PTL 4: JP 2-225651 A
PTL 5: JP 59-96254 A

SUMMARY OF THE INVENTION

However, although a Cu—Ni—Sn-based copper alloy is able to obtain a high mechanical strength by spinodal decomposition type age-hardening, the strength is not sufficient in some cases. In addition, when it is intended to increase the mechanical strength, the heat resistance may be degraded in some cases. Accordingly, in a Cu—Ni—Sn-based copper alloy, a further increase in mechanical strength and a suppression of degradation in heat resistance are desired.

The present invention was made to overcome the problems as described above and primarily aims to further increase the mechanical strength of a Cu—Ni—Sn-based copper alloy and to suppress the degradation in heat resistance thereof.

Solution to Problem

In order to achieve the primary aims described above, a method for manufacturing a copper alloy and a copper alloy of the present invention are configured as described below.

A method for manufacturing a copper alloy of the present invention is a method for manufacturing a Cu—Ni—Sn-based copper alloy, and the method comprises:

- a first aging treatment step of performing an aging treatment in a temperature range of 300° C. to 500° C. using a solution treated material which is processed by a solution treatment;
- an inter-aging processing step of performing cold working after the first aging treatment step; and
- a second aging treatment step of performing an aging treatment in a temperature range of 300° C. to 500° C. after the inter-aging processing step.

According to this method for manufacturing a copper alloy, in the Cu—Ni—Sn-based copper alloy, the mechanical strength can be further increased, and the degradation in heat resistance can be suppressed. The reasons the effects as described above can be obtained are inferred as follows. First, when a peak aging treatment is performed on the solution treated material, compound phases, such as the $DO_{22}$ ordered phase and the $L1_2$ ordered phase, are precipitated in a composite manner, and the mechanical strength is improved by precipitation hardening. When cold working is then performed, since the dislocation density is increased and/or deformation twins, that is, primary twins and secondary twins, are generated by deformation, structural refining can be performed, and as a result, the mechanical strength is further improved. However, when the temperature is increased while a stress is applied, dislocations at a high density are liable to move, and the heat resistance may be degraded in some cases. Hence, when an aging treatment is further performed, the Cottrell atmosphere is formed around the dislocations generated at a high density, and the dislocations are fixed, so that the degradation in heat resistance can be suppressed. As described above, it is believed that the mechanical strength can be further increased, and the degradation in heat resistance can be suppressed.

DESCRIPTION OF THE PREFERRED EMBODIMENTS

Figure 1:
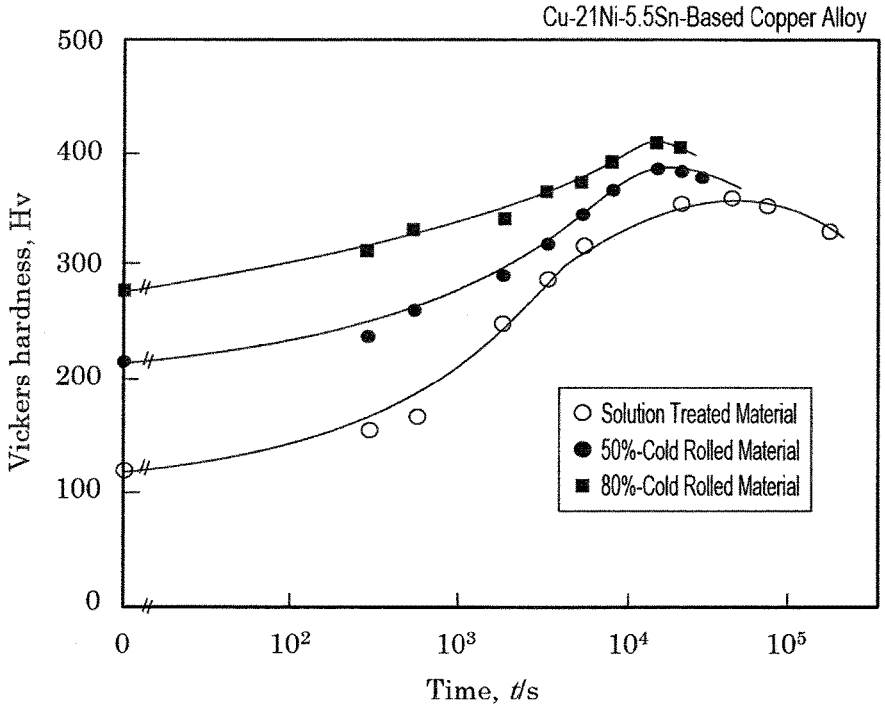
FIG. 1 is a graph showing the relationship between an aging treatment time and a Vickers hardness of a Cu-21Ni-5.5Sn-based copper alloy.

Hereinafter, a method for manufacturing a copper alloy and a copper alloy according to one embodiment of the present invention will be described. This method for manufacturing a copper alloy may include (1) a melting/casting step, (2) a homogenizing treatment step, (3) a pre-processing step, (4) a solution treatment step, (5) a first aging treatment step, (6) an inter-aging processing step, and (7) a second aging treatment step. In addition, the copper alloy may be formed by this manufacturing method.

(1) Melting/Casting Step

In this step, after raw materials are mixed together to have a desired alloy composition, an ingot is obtained by performing melting/casting of the mixture thus prepared. Although the ingot may be used as long as having a Cu—Ni—Sn-based copper alloy composition, the ingot preferably contains 3 to 25 percent by mass of Ni and 3 to 9 percent by mass of Sn. When an ingot having the composition as described above is used, since the age-hardening ability is high, the mechanical strength can be further increased, and the decrease in electrical conductivity can also be suppressed. In particular, for example, a composition represented by Cu-21Ni-5.5Sn, Cu-15Ni-8Sn, Cu-9Ni-6Sn, or the like may be used. The alloy composition may also contain, besides Ni and Sn, 0.05 to 0.5 percent by mass of Mn. When 0.05 percent by mass or more of Mn is contained, since discontinuous precipitation of Ni and/or Sn occurred around crystal grain boundaries, which is called a "grain boundary reaction", can be suppressed, for example, a decrease in strength caused by embrittlement of the interface is not likely to occur, and hence, Mn contained within this range is more suitable to increase the mechanical strength. In addition, when the content of Mn is 0.5 percent by mass or less, the amount of Mn, which may degrade hot processability in some cases, is not excessively large, and hence, the degradation in manufacturability can be suppressed. In the alloy composition, the balance may contain only Cu or Cu and inevitable impurities. As the inevitable impurities, for example, P, Al, Mg, Fe, Co, Cr, Ti, Zr, Mo, and W, may be mentioned. The content of those inevitable impurities is preferably 0.1 percent by mass or less as a whole. The melting and casting may be performed by a known method. For example, although it is preferable to perform metallic die casting by high frequency induction heating melting in the air or in an inert gas atmosphere of nitrogen or the like, melting may be performed using a crucible in an electric furnace, or continuous casting may be performed using a graphite die or a copper casting die. The method is not limited to those described above, and other methods may also be used.

(2) Homogenizing Treatment Step

In this step, a homogenizing treatment is performed to obtain a homogenized material having a homogenous structure by eliminating from the ingot, a heterogeneous structure having an adverse influence to the following steps, such as segregation generated in a non-equilibrium manner during casting. In this step, the ingot obtained by the melting/casting step may be heated to a temperature range of, for example, 780° C. to 950° C. and held for a holding time of, for example, 0.5 to 24 hours.

(3) Pre-Processing Step

In this step, the homogenized material is processed into a pre-processed material which has dimensions suitably used for the inter-aging processing performed later. In this step, hot processing only may be performed, cold working only may be performed, or hot processing and cold working both may be performed. In addition, the type of processing is not particularly limited, and for example, rolling processing, press processing, extrusion processing, drawing processing, or forging may be performed. Among those mentioned above, in order to form a plate shape, rolling processing is preferable.

(4) Solution Treatment Step

In this step, a solution-treated material in which Ni and Sn (with or without Mn) are solid-dissolved in Cu is obtained. In this step, for example, the pre-processed material may be heated to a temperature range of, for example, 780° C. to 950° C. and held for a holding time of, for example, 0.5 to 6 hours, and subsequently, cooled by water cooling or air cooling so that the surface temperature reaches, for example, 20° C. or less. In this step, the cooling is preferably performed as rapidly as possible. In the case described above, the temperature decrease rate is preferably 50° C./s or more and more preferably 100° C./s or more.

(5) First Aging Treatment Step

In this step, an aging treatment is performed using the solution treated material at a temperature range of 300° C. to 500° C., so that a first aging treated material is obtained. This aging treatment is preferably a peak aging treatment or a treatment performed for a shorter period than that thereof, and the peak aging treatment is more preferable. In this case, the peak aging treatment indicates an aging treatment which is performed so that a heating temperature thereof is held until the micro Vickers hardness (hereinafter simply referred to as the "hardness" in some cases) reaches the maximum. In addition, since it is difficult to exactly obtain the time at which the hardness is maximized, in this application, an aging treatment performed so that heating is held for a time range in which 90% or more of the maximum hardness can be obtained is called the peak aging treatment. In this step, although the temperature range at which the aging treatment is performed may be 300° C. to 500° C., this temperature range is preferably 400° C. or more and more preferably 420° C. or more. The reason for this is that in this temperature range, compound phases, such as the $DO_{22}$ ordered phase and the $L1_2$ ordered phase, are generated from the spinodal decomposition state. In addition, the temperature range is preferably 500° C. or less and more preferably 480° C. or less. The reason this temperature range is preferable is that although the compound phases, such as the $DO_{22}$ ordered phase and the $L1_2$ ordered phase, are generated, the $DO_3$ equilibrium phase is not generated, and the grain boundary reaction is not likely to occur. In addition, the $DO_{22}$ ordered phase, the $L1_2$ ordered phase, and the $DO_3$ equilibrium phase each have a cubic crystal structure and are believed to be a $(Cu,Ni)_3Sn$ phase having a superlattice structure. In this step, the time for the aging treatment may be experimentally determined, for example, in accordance with the temperature of the aging treatment and the dimensions of the solution treated material, and may be set in a range of, for example, 30 minutes to 24 hours. In particular, the time for the aging treatment is preferably 1 hour or more and more preferably 2 hours or more. The reason for this is that depending on the size to be treated, the time described above is required to generate the compound phases, such as the $DO_{22}$ ordered phase and the $L1_2$ ordered phase. In addition, the time for the aging treatment is preferably 12 hours or less and more preferably 6 hours or less. The reason for this is that depending on the size to be treated, the time described above is sufficient to generate the compound phases, such as the $DO_{22}$ ordered phase and the $L1_2$ ordered phase.

(6) Inter-Aging Processing Step

In this step, cold working is performed to obtain an inter-aging processed material. In the present invention, the cold working indicates a processing performed in a temperature range in which the material temperature is set to 200° C. or less. The cold working may be performed, for example, at room temperature without intentional heating. The type of processing is not particularly limited, and for example, rolling processing, press processing, extrusion processing, drawing processing, or forging may be performed. Among those mentioned above, in order to form a plate shape, rolling processing is preferable. This cold working is preferably performed at a processing rate of more than 60% to 99%. In particular, the processing rate is preferably 70% or more and more preferably 80% or more. The reason for this is that since the dislocation density is increased in the material, processing can be performed to obtain a sufficient process hardening. The processing rate is preferably 99% or less and more preferably 95% or less. The reason for this is that when the process hardening progresses, the process efficiency may be decreased in some cases (for example, in the case of rolling, the number of rolling passes required to obtain a target processing rate is increased). Here, the processing rate R (%) can be obtained by the equation: $R=(A_0-A)\times100/A_0$, where $A_0$ ($mm^2$) represents the cross-sectional area before processing and A ($mm^2$) represents the cross-sectional area after processing. In the case in which rolling is performed, when the plate thickness before rolling and the plate thickness after rolling are represented by $t_0$(mm) and t (mm), respectively, the processing rate R (%) may be obtained by the following equation: $R=(t_0-t)\times100/t_0$.

(7) Second Aging Treatment Step In this step, an aging treatment is performed in a temperature range of 300° C. to 500° C. to obtain a second aging treated material. In this step, the aging treatment is preferably performed for a shorter period than that of the aging treatment in the first aging treatment step. Accordingly, since an over-aging state is not likely to occur, it is suitable to increase the mechanical strength. Although the aging treatment temperature may be set to 300° C. to 500° C., the temperature is preferably 400° C. or more and more preferably 420° C. or more. The reason for this is that in this temperature range, the compound phases, such as the $DO_{22}$ ordered phase and the $L1_2$ ordered phase, are generated from the spinodal decomposition state. In addition, the temperature range is preferably 500° C. or less and more preferably 480° C. or less. The reason for this is that in this temperature range, although the compound phases, such as the $DO_{22}$ ordered phase and the $L1_2$ ordered phase, are generated, the $DO_3$ equilibrium phase is not generated, and the grain boundary reaction is not likely to occur. This aging treatment temperature is preferably the same as or less than that of the first aging treatment step. Although the aging treatment temperature may be set higher than that of the first aging treatment step, the aging treatment is preferably performed for a further shorter period in this case. In this step, the time for the aging treatment may be experimentally determined, for example, in accordance with the aging treatment temperature, the dimensions of the inter-aging processed material, and the processing rate in the inter-aging processing step, and may be set in a range of, for example, 15 minutes to 12 hours. In particular, the time described above is preferably 30 minutes or more and more preferably 1 hour or more. The reason for this is that depending on the size to be processed, the time described above is required so that Sn is diffused and fixed around the dislocations introduced by the processing, or the compound phases, such as the $DO_{22}$ ordered phase and the $L1_2$ ordered phase, are generated. In addition, the time is preferably 6 hours or less and more preferably 3 hours or less. The reason for this is that depending on the size to be processed, the time described above is sufficient so that Sn is diffused and/or the compound phases, such as the $DO_{22}$ ordered phase and the $L1_2$ ordered phase, are generated.

The tensile strength of the copper alloy of the present invention is preferably 1,100 MPa or more, more preferably 1,200 MPa or more, and further preferably 1,300 MPa or more. In addition, the 0.2%-proof stress of the copper alloy of the present invention is preferably 1,050 MPa or more, more preferably 1,150 MPa or more, and further preferably 1,250 MPa or more. In addition, the micro Vickers hardness of the copper alloy of the present invention is preferably 400 Hv or more, more preferably 410 Hv or more, and further preferably 420 Hv or more. A copper alloy which satisfies at least one of those described above may be regarded as an alloy having a particularly high mechanical strength. Although not particularly limited, the upper limit of the tensile strength may be set, for example, to 1,500 MPa or less. In addition, although not particularly limited, the upper limit of the 0.2%-proof stress may be set, for example, to 1,450 MPa or less. Furthermore, although not particularly limited, the upper limit of the micro Vickers hardness may be set, for example, to 480 Hv or less.

The stress relaxation rate of this copper alloy obtained after a stress of 80% of the 0.2%-proof stress is applied thereto for 100 hours in an atmosphere at 200° C. is preferably 20% or less, more preferably 15% or less, and further preferably 10% or less. A copper alloy which satisfies those described above may be regarded as an alloy which can particularly suppress the degradation in heat resistance. Although not particularly limited, the lower limit of the stress relaxation rate may be set, for example, to 0.01% or more.

The dislocation density of this copper alloy is preferably $8.0\times10^{14}$ $m^{-2}$ or more, more preferably $1.0\times10^{15}$ $m^{-2}$ or more, and further preferably $1.2\times10^{15}$ $m^{-2}$ or more. By an alloy having a high dislocation density as described above, the mechanical strength can be further increased. Although not particularly limited, the upper limit of the dislocation density may be set, for example, to $1.0\times10^{16}$ $m^{-2}$ or less. It is preferable that in this copper alloy, deformation twins are uniformly introduced into the whole structure. The reason for this is that for example, since the deformation twin plays a role similar to that of the crystal grain boundary and suppresses the movement of the dislocation, the deformation twin is suitable to increase the mechanical strength and to suppress the degradation in heat resistance. In this case, the average twin boundary spacing of the deformation twins is preferably 5 μm or less, more preferably 1 μm or less, and further preferably 0.1 μm or less. In addition, in this copper alloy, it is preferable that the $DO_{22}$ ordered phase and the $L1_2$ ordered phase are formed, and that no concentration modulation structure caused by the spinodal decomposition is observed. The reason for this is that, although it is believed that the stress relaxation characteristics are improved by the concentration modulation structure caused by the spinodal decomposition in a general Cu—Ni—Sn-based copper alloy, the stress relaxation characteristics can also be improved by the mechanism different from that described above.

It is preferable that, when this copper alloy is deformed at a constant strain rate, a rapid decrease in stress occurs once at a yield point in the stress-stain curve, that is, it is preferable that the yield phenomenon is observed. It is believed that this phenomenon occurs when the dislocation is fixed by the Cottrell atmosphere. In addition, it is preferable that, when this copper alloy is deformed at a constant strain rate, the serration is confirmed in the stress-strain curve. This phenomenon is also believed to show that the dislocation is fixed by the Cottrell atmosphere. It is believed that since the dislocation is fixed, the mechanical strength is improved, and the degradation in heat resistance can be suppressed.

The electrical conductivity of this copper alloy is preferably 5% IACS or more and more preferably 6% IACS or more. The reason for this is that a copper alloy is frequently used in applications required to have electrical conductivity and is suitably used for the applications described above. In addition, the electrical conductivity used in this embodiment indicates an electrical conductivity based on a relative rate obtained when the electrical conductivity of annealed international standard soft copper at ordinary temperature (20° C. in general) is regarded as 100%, and as the unit of this electrical conductivity, % IACS is used.

According to the method for manufacturing a copper alloy and the copper alloy described above, in a Cu—Ni—Sn-based copper alloy, the mechanical strength can be further increased, and the degradation in heat resistance can be suppressed. The reasons those effects can be obtained are inferred as follows. First, when the peak aging treatment is performed on the solution treated material, the compound phases, such as the $DO_{22}$ ordered phase and the $L1_2$ ordered phase, are precipitated in a composite manner, and hence, the mechanical strength is improved by precipitation hardening. When cold working is then performed, since the dislocation density is increased and/or deformation twins (primary twins and secondary twins) are generated, the mechanical strength is further improved. It is believed that, for example, in a wide area in which the width of the primary twin is 150 nm or more, since the secondary twins are generated in a direction at an angle of 71° with respect to the primary twin, the primary twins are only generated, or the secondary twins are also generated so as to compensate for the primary twins, and as a result, the structural refining occurs. The generation of the deformation twins as described above becomes apparent when rolling is performed after the peak aging, and the average twin boundary spacing is also decreased. However, when the temperature is increased while a stress is applied, dislocations at a high density are liable to move, and hence the heat resistance may be degraded in some cases. Hence, when an aging treatment is further performed, the Cottrell atmosphere is formed around the dislocations generated at a high density, and the dislocations are fixed thereby, so that the degradation in heat resistance can be suppressed. As described above, it is believed that the mechanical strength can be further increased, and the degradation in heat resistance can be suppressed.

In addition, the present invention is not limited at all to the embodiment described above, and it is to be naturally understood that the present invention can be performed in various modes without departing from the technical scope of the present invention.

For example, although the method for manufacturing a copper alloy is configured to include (1) the melting/casting step, (2) the homogenizing treatment step, (3) the pre-processing step, (4) the solution treatment step, (5) the first aging treatment step, (6) the inter-aging processing step, and (7) the second aging treatment step in the above embodiment, the method may include only some of the steps described above. For example, the steps (1) to (4) may be omitted, and the step (5) and the following steps may be performed using a solution treated material which is separately prepared. The treatments of the steps (2) and (3) may be omitted, or other steps may be performed instead thereof.

EXAMPLES

Hereinafter, the cases in which the copper alloy of the present invention is formed will be described in detail as Examples.

1. Manufacture of Test Sample (Formation of Solution Treated Material)

First, an ingot of a Cu-21Ni-5.5Sn-based copper alloy was formed using a highly purified crucible in a nitrogen atmosphere at 1,150° C. Next, after a cast structure was slabbed by hot forging into a thick plate having predetermined dimensions, a homogenizing treatment, a 70%-cold rolling treatment, and a solution treatment were performed in this order, so that a solution treated material was obtained. The solution treatment was performed in such a way that a cold rolled material was held in vacuum at 800° C. for 30 minutes and was then water quenched.

(Formation of Cold Rolled Material)

The solution treated material was cold rolled to have a processing rate of 50% to 80%, so that 50 to 80%-cold rolled materials were formed (Comparative Examples 1 and 2 which will be described later).

(Determination of Peak Aging Time)

The peak aging time of an aging treatment at 400° C. performed on the solution treated material was obtained as described below. First, an aging treatment was performed on the solution treated material at 400° C. for a predetermined time, so that a plurality of samples processed by different aging times was formed. The hardness of each sample thus formed was measured, and the relationship between the aging treatment time and the hardness was investigated. A time at which the hardness was maximized was regarded as the peak aging time. For the 50 to 80%-cold rolled materials, the peak aging time of the aging treatment performed at 400° C. was obtained in a manner similar to that described above. FIG. 1 is a graph showing the relationship between the aging treatment time and the Vickers hardness of a Cu-21Ni-5.5Sn-based copper alloy. The details of a method for measuring the hardness will be described later.

Figure 2:
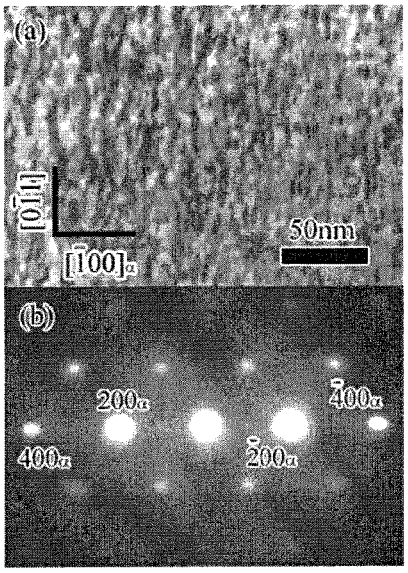
FIG. 2 shows a TEM photo (a) and a [011]α selected-area electron diffraction image (b) of a sample obtained by holding (sub-aging) of a solution treated material at 400° C. for 5 minutes.
Figure 3:
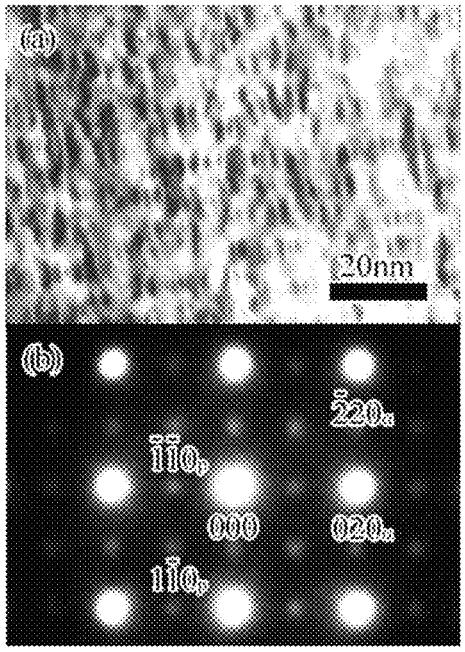
FIG. 3 shows a TEM photo (a) and a [001]α selected-area electron diffraction image (b) of a sample obtained by holding (peak aging) of a solution treated material at 400° C. for 10 hours.
Figure 4:
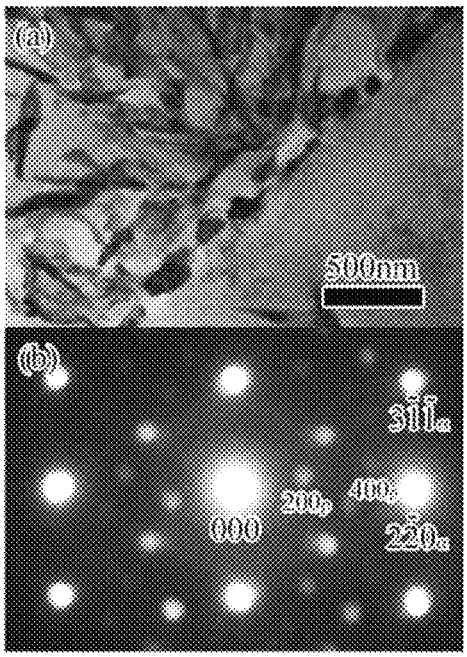
FIG. 4 shows a TEM photo (a) and a [112]α selected-area electron diffraction image (b) of a sample obtained by holding (over-aging) of a solution treated material at 400° C. for 50 hours.

Subsequently, in order to confirm the structural change by the aging treatment, TEM observation and x-ray diffraction were performed on samples processed by different aging times for each of the solution treated material, the 50%-cold rolled material, and the 80%-cold rolled material. FIG. 2 shows a TEM photo (a) and a [011]α selected-area electron diffraction image (b) of a sample obtained by holding (sub-aging) of the solution treated material at 400° C. for 5 minutes. FIG. 3 shows a TEM photo (a) and a [001]α selected-area electron diffraction image (b) of a sample obtained by holding (peak aging) of the solution treated material at 400° C. for 10 hours. FIG. 4 shows a TEM photo (a) and a [112]α selected-area electron diffraction image (b) of a sample obtained by holding (over-aging) of the solution treated material at 400° C. for 50 hours. In FIG. 2(*a*), linear contrasts parallel to the <110> direction, due to the minute periodical variation of the element concentration in the <001> direction, that is, due to the modulation structure, are observed. In addition, in FIG. 2(*b*), when attention is paid on the (002)α and the (004)α diffraction spots of a mother phase, the diffraction spots slightly extend in the <001> direction, which is caused by the generation of the modulation structure, to form a leaf-like shape. It has been known that the modulation structure has a minute structural mode in which the solute atom concentration varies periodically, and because of this structural mode, a diffraction intensity (side band) having two subsidiary maxima at two sides thereof appears close to the main diffraction line of the x-ray diffraction. When x-ray diffraction measurement was performed on the sample which was held at 400° C. for 5 minutes, a side band close to the main diffraction line was observed. Hence, it was found that the modulation structure was generated in the Cu-21Ni-5.5Sn-based copper alloy at an initial aging stage. In FIG. 3(*b*), the presence of ordered lattice reflection could be confirmed. According to the analysis thereof, it was found that the ordered lattice reflection corresponded to an $L1_2$ type ordered phase. The ordered lattice reflection was recognized at an early aging stage (was also confirmed in FIG. 2(*a*)) and became apparent as the aging progressed. This $L1_2$ type ordered phase is a metastable phase periodically formed in a region of a high Sn atomic concentration which is generated by the modulation structure. It is inferred that in the Cu-21Ni-5.5Sn-based copper alloy, the $L1_2$ type ordered phase has significant contribution to the age-hardening. In FIG. 4(*a*) showing the state of an over-aging stage in which the hardness is decreased, the formation of a grain boundary reaction cell was confirmed. According to the analysis thereof, it was confirmed that this gain boundary reaction cell was an equilibrium γ phase. In the 50%-cold rolled material and the 80%-cold rolled material, a result similar to that described above was also obtained.

From FIGS. 1 to 4, it was found that a preferable structure was obtained by performing peak aging. It was also found that, for the Cu-21Ni-5.5Sn-based copper alloy, the peak aging time for the solution treated material was approximately 10 hours, the peak aging time for the 50%-cold rolled material was 5 hours, and the peak aging time for the 80%-cold rolled material was 4 hours. Using these results, Cu-21Ni-5.5Sn-based copper alloys of Examples 1 to 3 and Comparative Examples 1 to 3 were formed.

(Formation of Different Solution Treated Material)

An ingot of a Cu-15Ni-8Sn-based copper alloy was formed. After this alloy was slabbed by hot forging into a thick plate having predetermined dimensions, a homogenizing treatment, a 50%-cold rolling treatment, and a solution treatment were performed in this order, so that a solution treated material was obtained. The solution treatment was performed in such a way that a cold rolled material was held in vacuum at 875° C. for 60 minutes and was then water quenched. An average crystal grain diameter d of the solution treated material of the Cu-15Ni-8Sn-based copper alloy was 55 (μm).

(Formation of Cold Rolled Material)

In addition, the solution treated material of the Cu-15Ni-8Sn-based copper alloy was cold rolled at a processing rate of 50% to 60%, so that a 50%-cold rolled material and a 60%-cold rolled material were formed (Comparative Examples 4 and 5 which will be described later).

(Determination of Peak Aging Time)

The peak aging time of an aging treatment at 400° C. performed on the solution treated material of the Cu-15Ni-8Sn-based copper alloy was obtained as described below. First, an aging treatment was performed on the solution treated material at 400° C. for a predetermined time, and a plurality of samples processed by different aging times was formed. The hardness of each sample thus formed was measured, and the relationship between the aging treatment time and the hardness was obtained. A time at which the hardness was maximized was regarded as the peak aging time. For the 50 to 60%-cold rolled materials, the peak aging time of the aging treatment performed at 400° C. was obtained in a manner similar to that described above. As a result, as is the case of the Cu-21Ni-5.5Sn-based copper alloy, it was found that a preferable structure was obtained by performing the peak aging. It was found that, for the Cu-15Ni-8Sn-based copper alloy, the peak aging time for the solution treated material was approximately 10 hours, the peak aging time for the 50%-cold rolled material was 4 hours, and the peak aging time for the 60%-cold rolled material was 2 hours. Using these results, Cu-15Ni-8Sn-based copper alloys of Examples 4 to 6 and Comparative Examples 4 to 7 were formed.

Example 1

First, the solution treated material of the Cu-21Ni-5.5Sn-based copper alloy was subjected to a peak aging treatment (held at 400° C. for 10 hours) (first aging treatment step). Subsequently, cold rolling at a processing rate of 80% was performed (inter-aging rolling step). Furthermore, an aging treatment was performed so that a temperature of 400° C. was held for 15 minutes (second aging treatment step). The alloy of Example 1 was thereby manufactured.

Examples 2 and 3

The alloy of Example 2 was manufactured in a manner similar to that of Example 1, except that the holding time at 400° C. in the second aging treatment step was set to 30 minutes. The alloy of Example 3 was manufactured in a manner similar to that of Example 1, except that the holding time at 400° C. in the second aging treatment step was set to 1 hour.

Example 4

The solution treated material of the Cu-15Ni-8Sn-based copper alloy was subjected to a peak aging treatment (held at 400° C. for 8 hours) (first aging treatment step). Subsequently, cold rolling at a processing rate of 50% was performed (inter-aging rolling step). Furthermore, an aging treatment was performed in which a temperature of 400° C. was held for 20 minutes (second aging treatment step). The alloy of Example 4 was thereby manufactured.

Examples 5 and 6

The alloy of Example 5 was manufactured in a manner similar to that of Example 4, except that cold rolling at a processing rate of 60% was performed and the holding time at 400° C. in the second aging treatment step was set to 40 minutes. The alloy of Example 6 was manufactured in a manner similar to that of Example 5, except that the holding time at 400° C. in the second aging treatment step was set to 1 hour.

Comparative Examples 1 and 2

The 50%-cold rolled material of the Cu-21Ni-5.5Sn-based copper alloy was subjected to a first aging treatment (held at 400° C. for 5 hours). The alloy of Comparative Example 1 was thereby manufactured. The 80%-cold rolled material of the Cu-21Ni-5.5Sn-based copper alloy was subjected to a first aging treatment (held at 400° C. for 4 hours). The alloy of Comparative Example 2 was thereby manufactured.

Comparative Example 3

The alloy of Comparative Example 3 was manufactured through steps similar to those of Example 1, except that the second aging treatment step was omitted.

Comparative Examples 4 and 5

The 50%-cold rolled material of the Cu-15Ni-8Sn-based copper alloy was subjected to a first aging treatment (held at 400° C. for 4 hours). The alloy of Comparative Example 4 was thereby manufactured. The use of the 60%-cold rolled material of the Cu-15Ni-8Sn-based copper alloy was subjected to a first aging treatment (held at 400° C. for 2 hours). The alloy of Comparative Example 5 was thereby manufactured.

Comparative Examples 6 and 7

The alloy of Comparative Example 6 was manufactured through steps similar to those of Example 4, except that after a first aging treatment (held at 400° C. for 10 hours) was performed, cold rolling was performed at a processing rate of 50%, and the second aging treatment step was omitted. The alloy of Comparative Example 7 was manufactured through steps similar to those of Example 4, except that after a first aging treatment (held at 400° C. for 10 hours) was performed, cold rolling was performed at a processing rate of 60%, and the second aging treatment step was omitted.

2. Tensile Test

Using a wire-cut electrical discharge machine, a plate-shaped molded test specimen having a parallel portion 20 mm in length, 6 mm in width, and 0.25 mm in thickness was formed. Subsequently, using a tensile test machine (AUTOGRAPH AG-X), a tensile test was performed at room temperature in the air and at an initial strain rate of $5\times10^{-3}$/sec. This tensile test was performed in accordance with JIS Z2201.

3. Hardness Measurement

The hardness was measured with a micro Vickers hardness meter at 2.9 N for 10 seconds. In this case, measurement was performed at 10 points of each sample at a central portion of a plate-thickness cross-section perpendicular to the rolling direction, and the average value thereof was obtained. This hardness measurement was performed in accordance with JIS Z2244.

4. Stress Relaxation Test (Heat Resistance Test)

Figure 5:
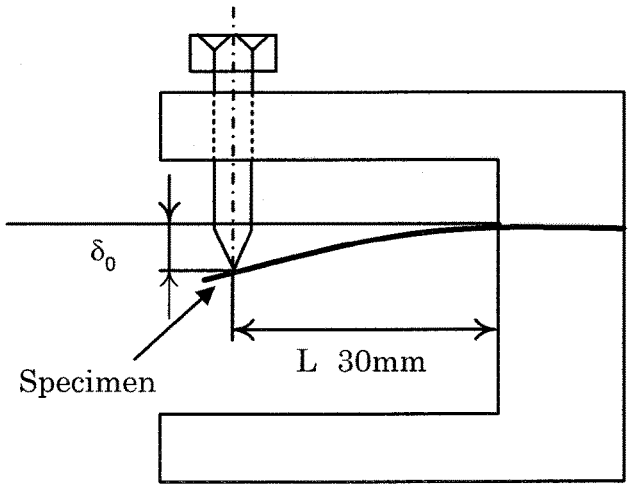
FIG. 5 is a view illustrating a test device used for a stress relaxation test.

The stress relaxation test was performed in accordance with the stress relaxation test by bending copper and copper alloy thin plates (Standards of JAPAN COPPER BRASS and ASSOCIATION, JCBA T309: 2001 (provisional)), and a method using a cantilever beam having a span length of 30 mm was employed. In particular, after one end portion of a test specimen was fixed by the use of a test device as shown in FIG. 5, an initial deflection displacement $\delta_0$ was applied to the test specimen by a bolt used for deflection displacement application. The initial deflection displacement was calculated by the following equation (1).

$$\delta_0=\sigma L^2/1.5EH \quad (1)$$

In the above equation, σ represents a stress of 80% of the 0.2%-proof stress (N/mm$^2$), L represents the span length (mm), H represents the thickness of the test specimen (ram), and E represents Young's modulus (N/mm$^2$).

Subsequently, the test specimen was held in an electric furnace in a nitrogen atmosphere at 200° C. together with the test device. After 100 hours passed, a permanent deflection displacement $\delta_r$ of the test specimen was measured, and the stress relaxation rate R (%) was calculated using the following equation (2).

$$R=(\delta_r/\delta_0)\times100 \quad (2)$$

5. Measurement of Electrical Conductivity

A volume resistance ρ of a test sample was measured in accordance with JIS H0505 and was converted into an electrical conductivity (% IACS) by calculating the rate thereof to the resistance (1.7241 μΩ·cm) of annealed international standard soft copper. For the conversion, the following equation was used. Electrical conductivity γ (% IACS)=1.7241/volume resistance ρ×100.

6. Optical Microscope Observation

The surface of a test specimen of a sample for optical microscope observation was polished with emery paper (#400 to #2000) and was further processed by buff polishing using alumina, so that a mirror surface was obtained. Then, the surface structure was observed using an optical microscope (BX51M manufactured by OLYMPUS). In addition, from an optical microscope photo of the cross-section perpendicular to a rolled surface and parallel to a rolling direction, the average spacing of grain boundaries in the direction perpendicular to the rolling direction was obtained as an average crystal grain diameter d (μm). In Examples 1 to 3 and Comparative Examples 2 and 3, d was 10 μm, and in Comparative Example 1, d was 30 μm. In Examples 4 to 6 and Comparative Examples 6 and 7, d was 15 μm, d was 27 μm in Comparative Example 4, and d was 22 μm in Comparative Example 5.

7. Transmission Electron Microscope (TEM) Observation

Internal structure observation was performed using a transmission electron microscope (JEOL2000EX manufactured by JEOL Ltd.) at an accelerating voltage of 200 kV. A sample for TEM observation was polished by mechanical polishing to have a thickness of approximately 0.2 mm and was then further cut into a small piece having a diameter of 3 mm. Subsequently, electrolytic polishing was performed using an electrolytic polishing machine (Ecopol manufactured by Chemical Yamamoto Co., Ltd.), so that a thin film sample was formed. As an electrolytic polishing liquid, a mixture containing nitric acid and methanol at a ratio of 1:4 was used. As the Ecopol use conditions, the voltage was set to 20.0 V (13.5 V during operation), and the distance between the sample and the electrode was set to 0.25 nm.

As for the electrolytic polishing conditions, the voltage, the current, and the liquid temperature were set to 6.0 V, 0.1 A, and −30° C., respectively. Since the deformation twin observed by a transmission electron microscope has been known to play a role similar to that of the crystal grain boundary with respect to the movement of the dislocation, the average twin boundary spacing obtained from a TEM photo was regarded as the average crystal grain diameter d in Examples 1 to 6 and Comparative Examples 3, 6, and 7. In Comparative Examples 1 and 2, since the deformation twins were locally generated, the twin boundary spacing could not be measured, and the amount of the deformation twins was small; hence, the average crystal grain diameter itself was used as the value d.

8. Measurement of Lattice Constant and Dislocation Density

X-ray diffraction measurement was performed with an x-ray diffraction apparatus (RINT2500 manufactured by Rigaku Denki), using a Cu tube at a tube voltage of 40 kV and a tube current of 200 mA, and the lattice constant and the dislocation density of a Cu mother phase were measured as described below. The values of the lattice constants obtained from diffraction peaks of individual planes were extrapolated by the function of $\cos^2\theta/\sin\theta$, and the value obtained thereby was used as the final lattice constant. In each of Examples 1 to 3 and Comparative Examples 1 to 3, this lattice constant was approximately 0.3618 nm. In addition, from the widths (half bandwidths) of diffraction peaks from the (111), the (220), and the (311) reflection planes, the strain was obtained using a modified Williamson-Hall method (see T. Kunieda, M, Nakai, Y, Murata, T. Koyama, M. Morinaga: ISIJ Int. 45 (2005), 1909 to 1914) and was converted into the dislocation density. A sample for x-ray diffraction was processed by mechanical polishing using emery paper #2000 and a buff having a size of 6 to 3 μm, so that the sample surface was placed in a mirror state. In addition, the surface of the sample was sufficiently flattened so as to minimize the error caused by decentering.

9. Experimental Results

Table 1 shows the tensile strength, the 0.2%-proof stress, the elongation, the hardness, the stress relaxation rate, the electrical conductivity, the crystal grain diameter, and the dislocation density of each of Examples 1 to 6 and Comparative Examples 1 to 7. From Table 1, it was found that in terms of the mechanical strength, the Comparative Example 3 and Examples 1 to 3 were superior to Comparative Examples 1 and 2. Similarly, it was found that in terms of the mechanical strength, the Comparative Examples 6 and 7 and Examples 4 to 6 were superior to Comparative Examples 4 and 5. In addition, in terms of the heat resistance, it was found that although being inferior to Comparative Examples 1 and 2, Examples 1 to 3 were superior to Comparative Example 3. Similarly, in terms of the heat resistance, it was found that although being inferior to Comparative Examples 4 and 5, Examples 4 to 6 were superior to Comparative Example 6. From the results described above, it was found that the mechanical strength was further increased and the degradation in heat resistance was suppressed in Examples 1 to 6 of this application. It was also found that, in Examples 1 to 6, the electrical conductivity was equivalent to that of Comparative Examples and could be suppressed from being degraded.

TABLE 1

| | STEP AFTER SOLUTION TREATMENT | | | | MECHANICAL STRENGTH | | | | HEAT RESISTANCE | OTHERS | | |
|---|---|---|---|---|---|---|---|---|---|---|---|---|
| | | FIRST AGING hr | INTER-AGING PROCESSING % | SECOND AGING min | TENSILE STRENGTH MPa | 02%-PROOF STRESS MPa | ELONGATION % | HARDNESS Hv | STRESS RELAXATION RATE % | ELECTRICAL CONDUCTIVITY % IACS | CRYSTAL GRAIN DIAMETER μm | DISLOCATION DENSITY $m^{-2}$ |
| EXAMPLE 1 | | 10 | 80 | 15 | 1310 | 1260 | 5 | 427 | 4 | 6 | 0.1 | $1.2 \times 10^{15}$ |
| EXAMPLE 2 | | 10 | 80 | 30 | 1310 | 1260 | 5 | 427 | 13 | 6 | 0.1 | $1.2 \times 10^{15}$ |
| EXAMPLE 3 | | 10 | 60 | 60 | 1310 | 1260 | 5 | 427 | 9 | 6 | 0.1 | $1.2 \times 10^{15}$ |
| EXAMPLE 4 | | 8 | 50 | 20 | 1280 | 1230 | 6 | 422 | 19 | 9 | 0.1 | $1.2 \times 10^{15}$ |
| EXAMPLE 5 | | 8 | 60 | 40 | 1300 | 1245 | 6 | 424 | 17 | 9 | 0.1 | $1.2 \times 10^{15}$ |
| EXAMPLE 6 | | 8 | 60 | 60 | 1290 | 1240 | 6 | 425 | 18 | 9 | 0.1 | $1.2 \times 10^{15}$ |
| COMPARATIVE EXAMPLE 1 | 50%-COLD ROLLED | 5 | | | 1020 | 970 | 7 | 385 | 2 | 6 | 30 | $6.4 \times 10^{14}$ |
| COMPARATIVE EXAMPLE 2 | 80%-COLD ROLLED | 4 | | | 1070 | 1010 | 6 | 403 | 2 | 6 | 10 | $7.9 \times 10^{14}$ |
| COMPARATIVE EXAMPLE 3 | | 10 | 80 | | 1310 | 1260 | 5 | 427 | 24 | 6 | 0.1 | $1.2 \times 10^{15}$ |
| COMPARATIVE EXAMPLE 4 | 50%-COLD ROLLED | 4 | | | 1080 | 1030 | 9 | 375 | 1 | 9 | 27 | $6.7 \times 10^{14}$ |

TABLE 1-continued

| | STEP AFTER SOLUTION TREATMENT | | | | MECHANICAL STRENGTH | | | | HEAT RESISTANCE | OTHERS | | |
|---|---|---|---|---|---|---|---|---|---|---|---|---|
| | | FIRST AGING hr | INTER-AGING PROCESSING % | SECOND AGING min | TENSILE STRENGTH MPa | 02%-PROOF STRESS MPa | ELONGATION % | HARDNESS Hv | STRESS RELAXATION RATE % | ELECTRICAL CONDUCTIVITY % IACS | CRYSTAL GRAIN DIAMETER μm | DISLOCATION DENSITY $m^{-2}$ |
| COMPARATIVE EXAMPLE 5 | 60%-COLD ROLLED | 2 | | | 1120 | 1070 | 7 | 388 | 2 | 9 | 11 | $7.2 \times 10^{14}$ |
| COMPARATIVE EXAMPLE 6 | | 10 | 50 | | 1160 | 1110 | 8 | 385 | 51 | 9 | 0.1 | $1.0 \times 10^{15}$ |
| COMPARATIVE EXAMPLE 7 | | 10 | 60 | | 1210 | 1170 | 8 | 405 | 54 | 9 | 0.1 | $1.2 \times 10^{15}$ |

X Cu-21Ni-5.5Sn Copper Alloy was used in Examples 1 to 3 and Comparative Examples 1 to 3.
Cu-15Ni-8Sn Copper Alloy was used in Examples 4 to 6 and Comparative Examples 4 to 6.

Figure 6:
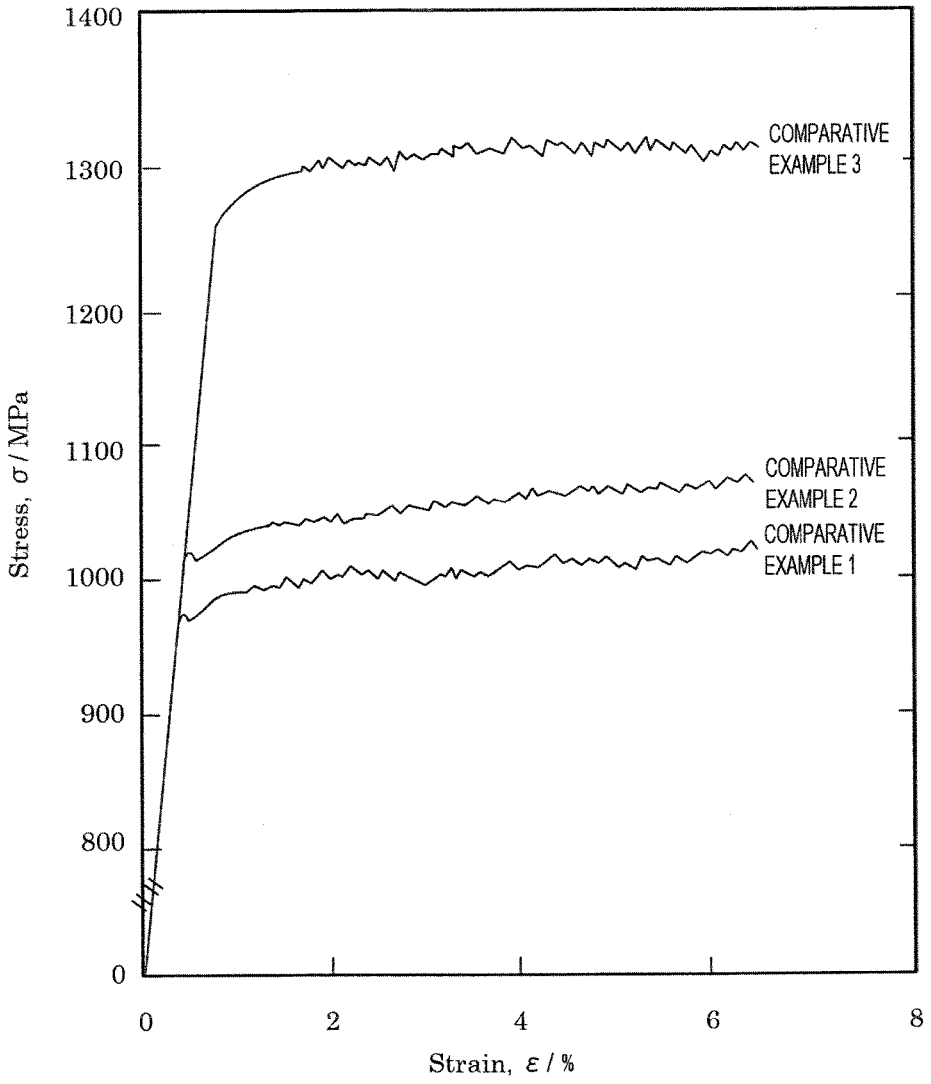
FIG. 6 shows stress-stain curves of Comparative Examples 1 to 3.

FIG. 6 shows stress-stain curves of Comparative Examples 1 to 3. In FIG. 6, in each of Comparative Examples 1 to 3, the serration was confirmed from the point at which the strain was close to approximately 2% or more. It is inferred that this serration indicated the decrease in mobility of dislocation due to the formation of the Cottrell atmosphere by solid-dissolved atoms, such as Sn and Ni. In Examples 1 to 3, serration similar to that described above was also confirmed. In addition, in FIG. 6, although the yield phenomenon was confirmed in Comparative Examples 1 and 2, the yield phenomenon was not confirmed in Comparative Example 3. The reason for this was inferred that since the cold rolling was performed after the aging in Comparative Example 3, the number of movable dislocations was increased. In addition, although not shown in the drawing, the yield phenomenon was confirmed in Example 3 as was the case of Comparative Examples 1 and 2, but in Examples 1 and 2, a clear yield phenomenon was not observed. The reason the yield phenomenon was confirmed in Example 3 was inferred that since the aging treatment was performed after the rolling, new Cottrell atmospheres were formed, and the movable dislocations were fixed thereby. On the other hand, the reason a clear yield phenomenon was not observed in Examples 1 and 2 was inferred that the number of newly formed Cottrell atmospheres was smaller than that of Example 3, and as a result, a fixing force of fixing the movable dislocations was not strong as compared to that of Example 3.

Figure 7:
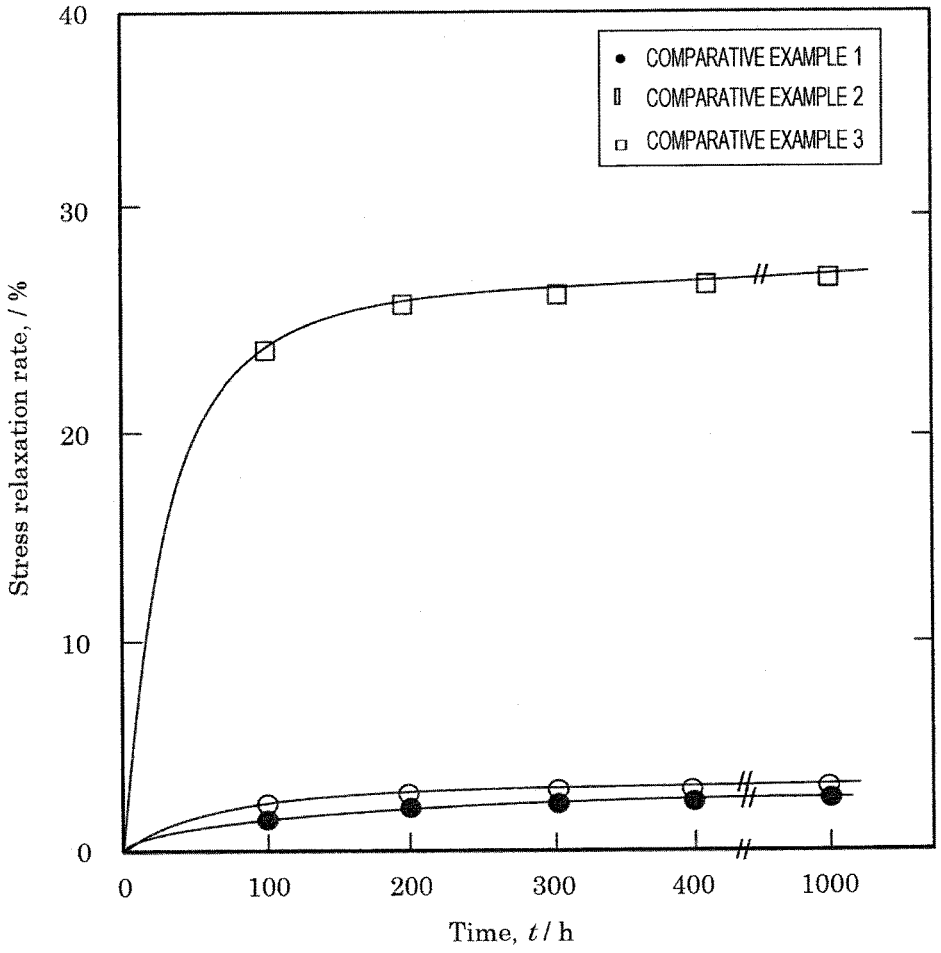
FIG. 7 shows the results of the stress relaxation test of Comparative Examples 1 to 3.

FIG. 7 shows the results of the stress relaxation test of Comparative Examples 1 to 3. In FIG. 7, the horizontal axis represents the holding time, and the vertical axis represents the stress relaxation rate. As shown in FIG. 7, in each of Comparative Examples 1 to 3, the stress relaxation rate was rapidly increased at the initial stage, and the rate of increase thereof was gradually decreased and finally reached an approximately constant value. In Examples 1 to 3, similarly, the stress relaxation rate was rapidly increased at the initial stage, and the rate of increase thereof was gradually decreased and finally reached an approximately constant value.

Figure 8:
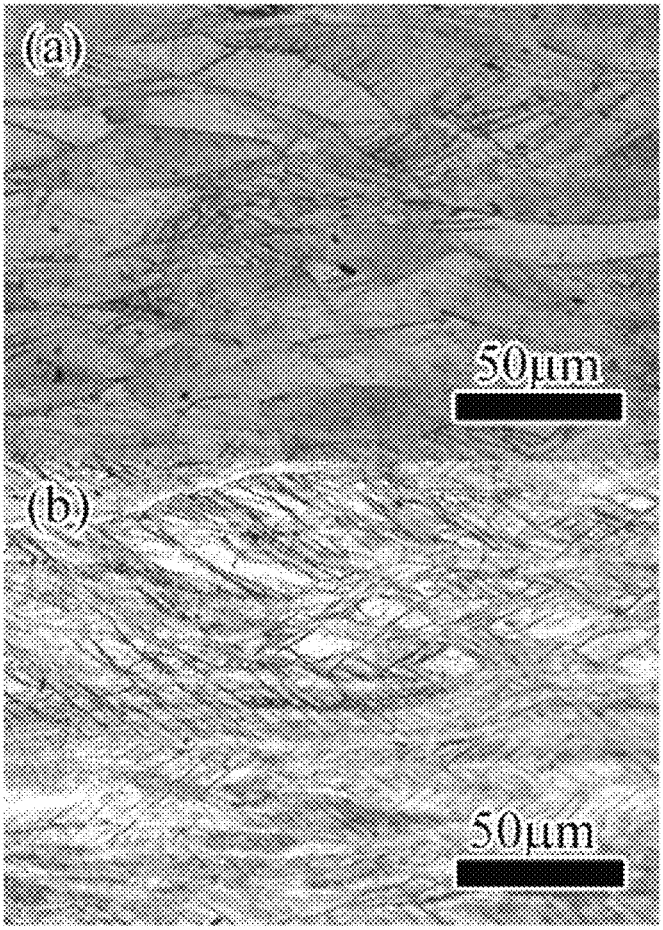
FIG. 8 shows an optical microscope photo (a) of Comparative Example 1 and an optical microscope photo (b) of Comparative Example 3.

FIG. 8 shows an optical microscope photo (a) of Comparative Example 1 and an optical microscope photo (b) of Comparative Example 3. As shown in FIG. 8(*a*), it was found that deformation twins were locally introduced in Comparative Example 1. In Comparative Example 2, the structure similar to that shown in FIG. 8(*a*) was confirmed. As shown in FIG. 8(*b*), it was found that deformation twins were present at a high density over the entire region of the sample in Comparative Example 3. In Examples 1 to 3, the structure similar to that shown in FIG. 8(*b*) was confirmed.

Figure 9:
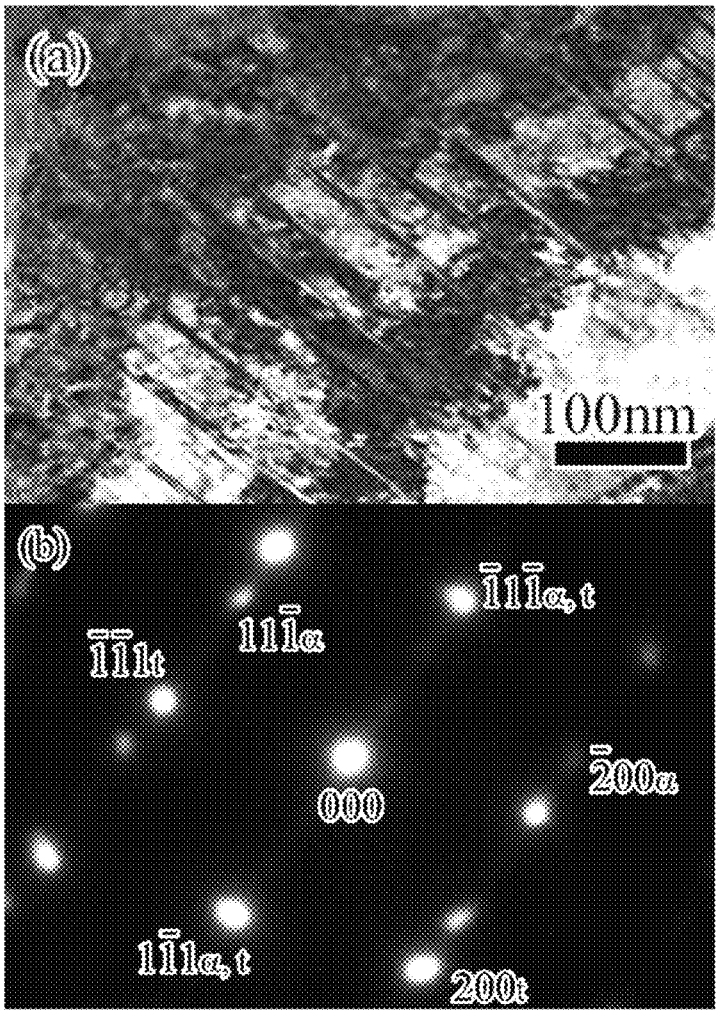
FIG. 9 shows a TEM photo (a) and a [011]α selected-area electron diffraction image (b) of deformation twins of Comparative Example 1.

FIG. 9 shows a TEM photo (a) and a [011]α selected-area electron diffraction image (b) of the deformation twins of Comparative Example 1. As shown in FIG. 9(*a*), it was found that the deformation twins were locally introduced in Comparative Example 1. In FIG. 9(*b*), two (011) diffraction patterns were overlapped with each other. It was found that those patterns had the mirror symmetry with respect to the {111}, and the crystals corresponding to those patterns had the twin relationship therebetween. The patterns of Examples 1 to 3 and Comparative Examples 2 and 3 were similar to those described above.

Figure 10:
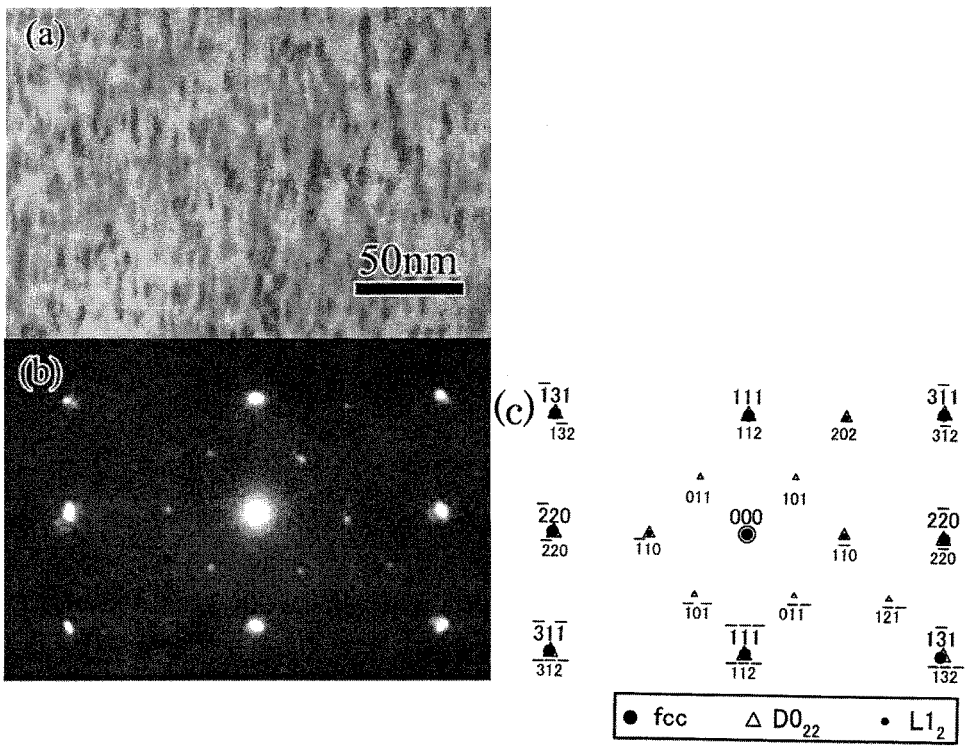
FIG. 10 shows a TEM image (a) and a selected-area electron diffraction image (b) of a sample obtained by performing an aging treatment in which a solution treated material of a Cu-21Ni-5.5Sn-based copper alloy is held at 450° C. for 150 minutes, and also shows a schematic view (c) of the selected-area electron diffraction image (b).

FIG. 10 shows a TEM image (a) and a selected-area electron diffraction image (b) of a sample obtained by performing an aging treatment at 450° C. for 150 minutes on a solution treated material (however, the treatment time was 4.5 minutes) of a Cu-21Ni-5.5Sn-based copper alloy and also shows a schematic view (c) of the selected-area electron diffraction image (b). As shown in FIG. 10, in this sample, precipitation of the $L1_2$ ordered phase and the $DO_{22}$ ordered phase were confirmed. From the results described above, it was found that in the copper alloy of this application, depending on the treatment conditions, the $L1_2$ ordered phase was not only precipitated but the $DO_{22}$ ordered phase was also precipitated.

Next, the stress relaxation test of the Cu-15Ni-8Sn-based copper alloy of each of Examples 4 to 6 and Comparative Examples 4 to 7 was performed. As a result, as the case of the Cu-21Ni-5.5Sn-based copper alloy shown in FIG. 6, the serration was confirmed in each sample from the point at which the strain was close to 2% or more. It was inferred that this serration indicated the decrease in mobility of the dislocation due to the formation of the Cottrell atmosphere by the solid-dissolved atoms, such as Sn and Ni. In addition, although the yield phenomenon was confirmed in Example 6 and Comparative Example 5, no yield phenomenon was confirmed in Comparative Example 7. The reason for this was inferred that at the stage at which the cold rolling was performed after the aging, the Cottrell atmosphere was not formed around dislocations at a high density. The reason the yield phenomenon was confirmed in Example 6 was believed that since the aging treatment was performed after the rolling, new Cottrell atmospheres were formed, and thereby movable dislocations were fixed.

Figure 11:
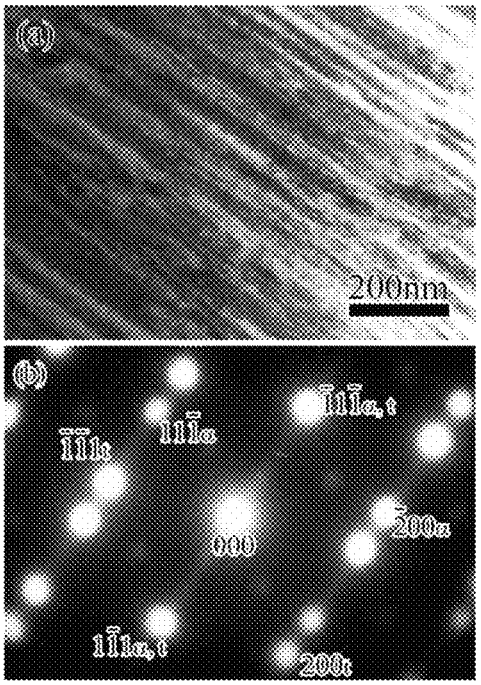
FIG. 11 shows a TEM photo (a) and a [011]α selected-area electron diffraction image (b) of deformation twins of Comparative Example 5.
Figure 12:
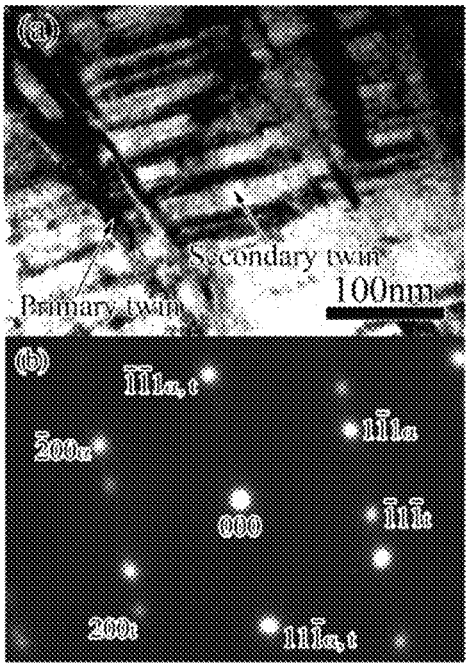
FIG. 12 shows a TEM photo (a) and a [011]α selected-area electron diffraction image (b) of deformation twins of Comparative Example 7.

FIG. 11 shows a TEM photo (a) and a [011]α selected-area electron diffraction image (b) of deformation twins of Comparative Example 5. It was found that in Comparative Example 5, the deformation twins were locally introduced. In addition, FIG. 12 shows a TEM photo (a) and a [011]α selected-area electron diffraction image (b) of deformation twins of Comparative Example 7. In Comparative Examples 6 and 7, the deformation twins were locally introduced, and among the deformation twins, besides main twins, sub-twins each having a direction (71°) different from that of the primary twin were confirmed. Hereinafter, the main twin is called the primary twin, and the sub-twin is called the secondary twin. The primary twin boundary spacing of Comparative Examples 6 and 7 was distributed in a range of 10 to 400 nm, and only in a Cu mother phase in which the primary twin boundary spacing is 150 nm or more, the secondary twins were confirmed. From the measurement results of this twin boundary spacing, it was found that compared to Comparative Examples 4 and 5 in which the cold rolling was performed after the solution treatment, in Comparative Examples 6 and 7 in which after the solution treatment, the first aging treatment and the cold rolling were performed, the twin boundary spacing was significantly small, and the twin boundary density was high.

From the results described above, the reason the mechanical strength can be further increased, and the degradation in heat resistance can be suppressed by the method for manufacturing a copper alloy of this application is inferred as follows. In the first aging treatment step, by the aging treatment, the structure is formed in which the $DO_{22}$ ordered phase and the $L1_2$ ordered phase, that is, the composite compound phases of $(Ni,Cu)_3Sn$ in the process of transformation, are precipitated. By the subsequent inter-aging processing (inter-aging rolling), the dislocation density is increased, and in addition, the deformation twins are uniformly introduced into a Cu mother phase hardened by precipitation, so that the strength is further increased. By the steps described above, although a high strength can be obtained, the dislocations at a high density may be placed in a movable state in an atmosphere at 200° C. (state in which stress relaxation is likely to occur) in some cases. In the second aging treatment step, the dislocations in this movable state are fixed. In this step, for example, since low melting-point Sn atoms are rapidly diffused so as to be fixed around the dislocations at a high density at which the lattice of the Cu mother phase is distorted, the dislocations are not allowed to move. By the steps described above, it is believed that the mechanical strength can be further increased, and at the same time, the degradation in heat resistance can also be suppressed.

This application claims the benefit of priority of Japanese Patent Application No. 2013-117634, filed on Jun. 4, 2013, the entire contents of which are hereby incorporated by reference herein.

What is claimed is:

1. A method for manufacturing a Cu—Ni—Sn-based copper alloy, the method comprising:

a first aging treatment step of performing an aging treatment in a temperature range of 300° C. to 500° C. using a solution treated material which is processed by a solution treatment;

an inter-aging processing step of performing cold working after the first aging treatment step; and a second aging treatment step of performing an aging treatment in a temperature range of 300° C. to 500° C. after the inter-aging processing step, wherein the Cu—Ni—Sn-based copper alloy contains 3 to 25 percent by mass of Ni, 3 to 9 percent by mass of Sn, 0.05 to 0.5 percent by mass of Mn, and the balance including copper and inevitable impurities, and wherein the Cu—Ni—Sn-based copper alloy has a micro Vickers hardness of 400 Hv or more.

2. The method for manufacturing a copper alloy according to claim 1, wherein in the first aging treatment step, a peak aging treatment is performed.

3. The method for manufacturing a copper alloy according to claim 1, wherein in the second aging treatment step, the aging treatment is performed for a short period as compared to that of the aging treatment in the first aging treatment step.

4. The method for manufacturing a copper alloy according to claim 1, wherein the time for the aging treatment in the first aging treatment step is set in a range of 30 minutes to 24 hours, and the time for the aging treatment in the second aging treatment step is set to 15 minutes to 12 hours.

5. The method for manufacturing a copper alloy according to claim 1, wherein in the inter-aging processing step, the cold working is performed at a processing rate of more than 60% to 99%.

6. The method for manufacturing a copper alloy according to claim 1, wherein the cold working is cold rolling.

7. A copper alloy manufactured by the manufacturing method according to claim 1, wherein the copper alloy has a tensile strength of 1,200 MPa or more, a 0.2%-proof stress of 1,150 MPa or more and a stress relaxation rate of 10% or less which is obtained after a stress of 80% of the 0.2%-proof stress is applied in an atmosphere at 200° C. for 100 hours.

8. The copper alloy according to claim 7, wherein the dislocation density is $1.0\times10^{15}$ $m^{-2}$ or more.

9. The copper alloy according to claim 7, wherein the copper alloy shows a yield phenomenon.

10. The method for manufacturing a copper alloy according to claim 1, wherein the Cu—Ni—Sn-based copper alloy has an electrical conductivity of 9% IACS or less.

* * * * *